United States Patent [19]

Kasai et al.

[11] 4,043,376

[45] Aug. 23, 1977

[54] CASTING PROCESS BY VACUUM MOLDING

[75] Inventors: Yuuji Kasai; Hironuri Ogura; Atsushi Toyoda, all of Hamamatsu, Japan

[73] Assignee: Nippon Gakki Seizo Kabushiki Kaisha, Japan

[21] Appl. No.: 696,628

[22] Filed: June 16, 1976

[51] Int. Cl.[2] ..... B22C 9/02; B22C 3/00; B22C 1/22

[52] U.S. Cl. ..... 164/7; 164/33; 164/37; 164/43; 164/137; 164/138

[58] Field of Search ..... 164/7, 33, 37, 40, 43, 164/137, 138, 160, 253

[56] References Cited

U.S. PATENT DOCUMENTS

| | | | |
|---|---|---|---|
| 3,106,540 | 10/1963 | Freedman | 164/43 X |
| 3,789,907 | 2/1974 | Nokata et al. | 164/7 |
| 3,825,058 | 7/1974 | Miura et al. | 164/253 |
| 3,838,095 | 9/1974 | Johnson et al. | 164/43 X |
| 3,878,159 | 4/1975 | Vargin et al. | 164/43 X |

FOREIGN PATENT DOCUMENTS

| | | | |
|---|---|---|---|
| 39-27744 | 3/1964 | Japan | 164/43 |
| 153,095 | 4/1961 | U.S.S.R. | 164/43 |

*Primary Examiner*—Ronald J. Shore
*Attorney, Agent, or Firm*—Ostrolenk, Faber, Gerb & Soffen

[57] ABSTRACT

In preparation of a mold for metal casting, a thermosetting resin layer, preferably of a thickness in a range from 2 to 100 micrometers, is formed between the refractory filler in the molding box and a covering laminate such as a thermoplastic synthetic resin film for tightly covering the filler surface so that the thermosetting resin layer develops, during metal casting, a shell layer for reinforcing the cavity wall of the mold due to heat given by molten metal. Development of casting defects such as sand marks and blow holes and occurrence of mold crumbling can effectively be prevented by the presence of the shell layer.

11 Claims, 5 Drawing Figures

CASTING PROCESS BY VACUUM MOLDING

Figure 1:
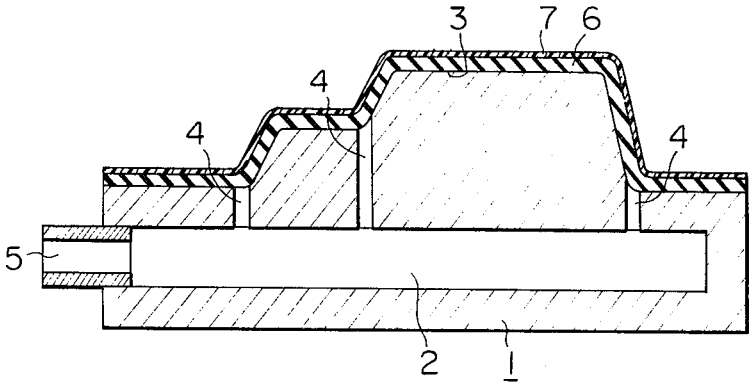

The present invention relates to improved casting process by vacuum molding.

In vacuum molding, the surface of the refractory filler, such as molding sand, to be exposed to the cavity of the mold is tightly covered by a covering laminate such as a thermoplastic synthetic resin film by application of pneumatic suction to the film. Thus, the wall of the cavity of the mold is wholly covered by the covering laminate, i.e., the synthetic resin film in general.

At the casting, molten metal of an extremely high temperature is filled into the cavity of the mold and evaporates the film on the wall of the cavity. Thus, the molten metal comes into direct contact with the refractory filler, is sucked pneumatically via the filler and solidified without crumbling of the mold.

However, in the actual casting process, it is often experienced with the upper half of the mold that the mold crumbles during filling of the molten metal. This is due to the fact that the molten metal firstly spreads in the cavity flowing over the cavity wall of the lower half of the mold before coming into contact with the cavity wall of the upper half of the mold, the film covering the cavity wall of the upper half of the mold evaporates due to the radiative heat given of by the molten metal in advance to contact with the molten metal and the exposed refractory filler is apt to crumble due to the disappearance of the covering film.

This trouble may start with the lower half of the mold, too, depending on the magnitude of the pneumatic suction pressure, the grain size of the refractory filler and spreading speed of the molten metal in the cavity of the mold. That is, as the molten metal spreads over the cavity wall of the lower half of the mold, the portion of the covering film close to the leading end of the molten metal gets evaporated and the refractory filler is exposed to the cavity. Direct contact of the refractory filler so exposed with the spreading molten metal inevitably causes development of casting defects such as sand marks and blow holes.

It is the principal object of the present invention to provide a novel casting process in which casting can be carried out with considerably reduced danger of mold crumbling.

It is another object of the present invention to provide a novel casting process which assures considerably mitigated development of casting defects such as sand marks and blow holes on the products obtained.

It is the other object of the present invention to provide a novel casting process which can produce products of excellent casting surface quality.

In accordance with the present invention, an alcohol solution of an initial condensate of a thermosetting resin such as phenolic, furan and urea is coated on the covering laminate on the pattern surface of the pattern during preparation of the mold. Preferably, the thickness of the resin coating is in a range from 2 to 100 micronmeters. Thus, after solidification of the refractory filler in the molding box, there exists a thermosetting resin layer in between the covering layer exposed into the cavity and the refractory filler, which forms a shell layer in the cavity wall at the time of molten metal casting.

Figure 2:
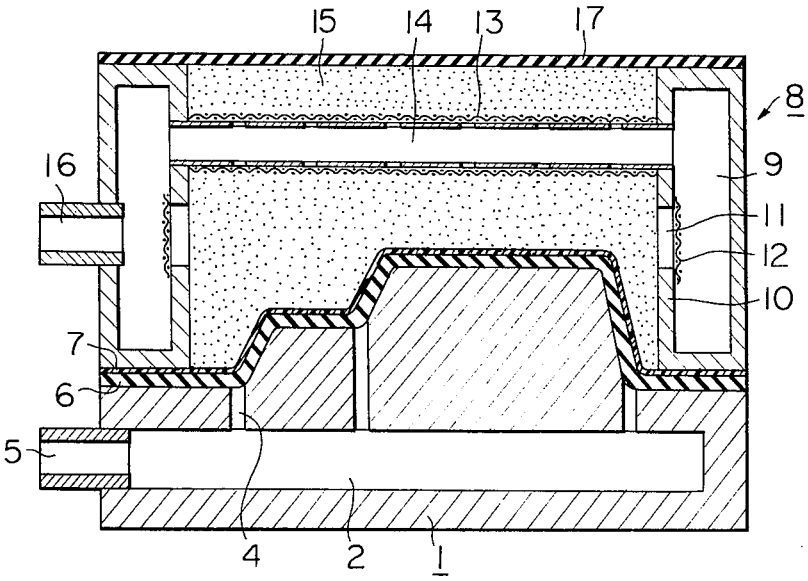
Figure 3:
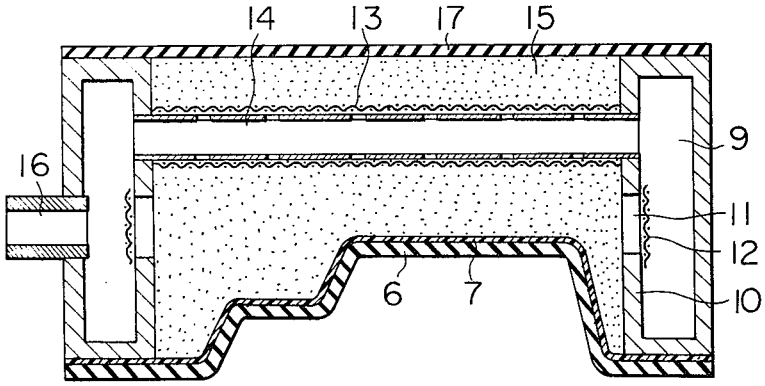
Figure 4:
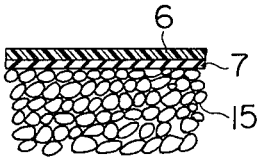

Further features and advantages of the present invention will be made clearer from the following description, reference being made to the accompanying drawings, in which;

FIGS. 1 through 3 are explanatory side sectional plan views for showing the process in accordance with the present invention, FIG. 4 is an enlarged side sectional view of the cavity wall configuration in the mold prepared in the process shown in FIGS. 1 through 3, and FIG. 5 is an enlarged side sectional view of the cavity wall configuration shown in FIG. 4 during molten metal casting.

The vacuum molding process in accordance with the present invention is shown in sequence in FIGS. 1 through 3.

In the first place, a pattern 1 such as shown in FIG. 1 is prepared. This patern 1 has a top pattern surface 3 of a predetermined shape and a suction chamber 2 confined therein. This suction chamber 2 on one hand is connected to a given suction source such as a vacuum pump (not shown) via a conduit 5 and on the other hand communicates to the pattern surface 3 via a number of suction holes 4.

A covering laminate 6, which is in general given in the form a thin thermoplastic synthetic resin film, is heated and placed over the pattern surface 3 of the pattern 1 in a stretched state and suction is started, thereby the covering laminate 6 being brought into a tight surface contact with the entire area of the pattern surface 3. The thickness of the covering laminate 6 is preferably in a range from 20 to 100 micronmeters.

Next, the covering laminate 6 is coated with an alcohol solution of an initial condensate of a thermosetting resin such as phenolic, furan and urea in order to form a thermosetting resin layer 7. The thickness of the coating is preferably in the range from 2 to 100 micronmeters in the sense of the solid component.

When the thickness of the coating falls short of 2 micronmeters, a later described shell layer cannot be formed thick enough to prevent crumbling of a refractory filler such as molding sand when molten metal is casted into the mold. Whereas, when the thickness of the coating exceeds 100 micronmeters, thermosetting resin not sucked to the refractory filler remains in between the molten metal and the shell layer, which may cause development of foundry defects on the casting surface.

Alcohol is used for the solvent of the initial condensate of the thermosetting resin for the reason that the critical surface tension of the synthetic resin film used as the covering laminate is in general 40 dyne/cm or smaller and alcohol well dissolves the initial condensate of the thermosetting resin while providing same with excellent wettability even under the critical surface tension value. However, various types of solvents other than alcohol can be used for the initial condensates of the thermosetting resin in accordance with the present invention without posing any undesirable influence upon smooth and successful prosecution of the process.

In addition, when the thickness of the resin coating falls within the above-described range, not only formation of the uniform coating layer on the film surface but also disposition of the resin in fine granular state on the film surface can assure successful result in the operation.

When preparation of the pattern 1 is complete, a molding box 8 is placed in known manner on the pattern surface 3 of the pattern 1 covered with the covering laminate 6 and the thermosetting resin layer 7.

As shown in FIG. 2, the molding box 8 is of a cavitious construction which is open at the top and bottom ends. The center cavity is surrounded by a corridor type suction chamber 9 which has a number of suction holes 11 formed through inner walls 10 thereof. A filter such as a wire net is disposed to each of the suction holes 11 in order to prevent undesirable invasion of the refractory filler granules into the suction system as such invasion causes fatal malfunction of the suction system. Across the center cavity, a plurality of porous suction pipes 14 are arranged horizontally while connecting one side of the suction chamber 9 to the other side thereof. A filter 13 is wound around each of the suction pipes 14 in order to protect the suction system from the refractory filler granules. The suction chamber 9 is connected to a given suction source (not shown) such as a vacuum pump via a conduit 16.

After the molding box 8 is set in position on the pattern 1, fluid refractory filler 15 such as molding sand is filled in the center cavity of the box, the top end of the box is closed with a suitable synthetic resin film 17 and suction is started via the suction system 9, 11, 14 and 16 in order to solidify the refractory filler in under pressure.

After the solidification is complete, suction on the side of the pattern 1 is stopped while suction on the side of the molding box 8 is retained. When the molding box 8 is lifted in this state, the same is separated from the pattern 1 and a mold half such shown in FIG. 3 is obtained.

The other mold half which should be coupled with this mold half in order to form a complete mold is prepared in substantially same way.

FIG. 4 shows in detail the part of the mold thus obtained, which defines the cavity of the mold. At the stage when preparation of the mold halves is complete, the solvent used for dissolving the initial condensate of the thermosetting resin has already volatilized. Thus, the surface of the solidified refractory filler is covered with the thermosetting resin layer 7 of 2 to 100 micronmeters thickness and the covering laminate 6 such as a synthetic resin film of 20 to 100 micronmeters thickness, the last member being exposed to the cavity of the mold.

Figure 5:
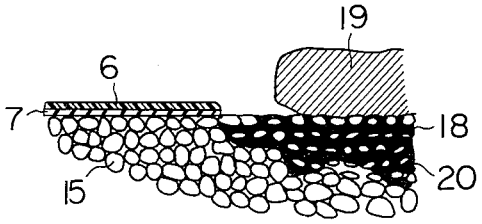

After the mold halves are coupled to each other in known manner in order to form a mold, the mold is subjected to casting, which process is shown in FIG. 5 in detail. At the casting, the molten metal 19 spreads over the wall of the cavity. Following this molten metal spreading, the portion of the covering laminate 6 in contact with the molten metal 19 and the portion of the covering laminate 6 close to the leading end of the spreading molten metal 19 are evaporated due to the heat given off by the molten metal 19, are sucked into the solidified refractory filler 15 and are fluidized therein in order to form a glutinous layer 20.

Concurrently with this procedure, the thermosetting resin layer 7 sandwiched by the covering laminate 6 and the refractory filler 15 is molten due to the heat given off by the molten metal 19, permeates into the refractory filler 15 in order to form and is solidified in order to form a shell layer 18. This shell layer 18 retains its strength until the cavity of the mold is filled with the molten metal and the latter is solidified being sucked to the shell layer 18, thereby effectively preventing mixing of the refractory filler into the molten metal 19. Presence of such a shell layer in the wall defining the cavity of the mold is especially advantageous in the case of the upper half of the mold in which evaporation of the covering laminate tends to take place due to the radiative heat given off by the molten metal.

The following example is illustrative of the present invention, but is not to be construed as limiting same.

EXAMPLE

A mold having a cavity of a rectangular solid shape was used for the casting. The length of the cavity was 300mm., the width 100mm. and the height 10mm. The pressure of the suction in the mold was 360 Torr. and grey cast iron was used as the casting metal at 1,400° C. Ionomer thermoplastic synthetic resin film of 50 micronmeters thickness, "Surlyn" produced by Du Pont, was used at about 100° C as the covering laminate. Methanol was used as the solvent for the thermosetting resins and the weight content of the resin in the solvent was 17%.

Results in the casting were evaluated in the following criteria.

In order to evaluate the sand mark grade and the blow hole grade, three pieces of cast pieces were prepared under a common processing condition and the surface of the each pieces was cut off by 2mm in thickness. The grades are shown in the form of averages of the number of defects observed on the three pieces.

The thicknesses of the resin coating are shown with the ones after evaporation of the solvent. But, except for novolak type phenol, the thicknesses of the coatings are shown with the ones in glutinous state.

The result of the evaluation is shown in the following table.

Table

| No. | Thermo-setting resin | Coating thickness in micron-meters | Casting surface | Sand mark defect | Blow hole defect |
|---|---|---|---|---|---|
| 1 | Novolak phenol | 1 | Somewhat rough | 10 | 0 |
| 2 | " | 2 | good | 1 | 0 |
| 3 | " | 5 | good | 0 | 0 |
| 4 | " | 10 | good | 0 | 0 |
| 5 | " | 15 | good | 0 | 0 |
| 6 | " | 20 | good | 0 | 0 |
| 7 | " | 40 | good | 0 | 0 |
| 8 | " | 50 | good | 0 | 1 |
| 9 | " | 75 | good | 0 | 1 |
| 10 | " | 100 | good | 0 | 1 |
| 11 | " | 110 | Tortoise shell like stripes | 0 | 2 |
| 12 | " | 120 | " | 0 | 2 |
| 13 | Resol phenol | 1 | Considerably rough | 20 | 0 |
| 14 | " | 2 | Somewhat rough | 5 | 0 |
| 15 | " | 5 | " | 5 | 0 |
| 16 | " | 10 | " | 4 | 0 |
| 17 | " | 15 | good | 2 | 0 |
| 18 | " | 20 | good | 1 | 0 |
| 19 | " | 40 | good | 1 | 1 |
| 20 | " | 70 | good | 1 | 2 |
| 21 | " | 100 | good | 0 | 5 |
| 22 | " | 110 | Tortoise shell like stripes | 0 | 5 |
| 23 | " | 120 | " | 0 | 5 |
| 24 | Furan | 1 | Considerably rough | 15 | 0 |
| 25 | " | 2 | Somewhat rough | 4 | 0 |
| 26 | " | 5 | " | 2 | 0 |
| 27 | " | 10 | " | 2 | 0 |
| 28 | " | 15 | good | 1 | 0 |
| 29 | " | 20 | good | 0 | 0 |
| 30 | " | 40 | good | 0 | 1 |
| 31 | " | 70 | good | 0 | 1 |
| 32 | " | 100 | good | 0 | 2 |
| 33 | " | 110 | Tortoise shell like stripes | 0 | 5 |
| 34 | " | 120 | " | 0 | 5 |
| 35 | Urea | 1 | Considerably rough | 30 | 0 |
| 36 | " | 2 | " | 20 | 0 |

Table-continued

| No. | Thermo-setting resin | Coating thickness in micron-meters | Casting surface | Sand mark defect | Blow hole defect |
|---|---|---|---|---|---|
| 37 | " | 5 | Somewhat rough | 10 | 0 |
| 38 | " | 10 | " | 5 | 0 |
| 39 | " | 15 | " | 3 | 0 |
| 40 | " | 20 | " | 3 | 0 |
| 41 | " | 40 | " | 2 | 0 |
| 42 | " | 75 | " | 1 | 0 |
| 43 | " | 100 | " | 1 | 0 |
| 44 | " | 110 | " | 1 | 2 |
| 45 | " | 120 | " | 1 | 2 |
| 46 | None | 0 | Considerably rough | 35 | 0 |

It will be well understood that, regardless of the difference in the resin used, use of the thermosetting resin layer assures excellent results in the casting process as long as the thickness is in the range from 2 to 100 micronmeters.

More advantageous results are obtained through use of the novolak type phenolic resin as the thermosetting resin. Further, the best results are obtained through use of the novolak type phenolic resin at a thickness in a range from 5 to 40 micronmeters.

As is clear from the foregoing description, employment of the present invention assures successful metal casting with enhanced casting surface condition and reduced development of casting defects such as sand marks and blow holes.

We claim:

1. Improved casting process by vacuum molding comprising, in sequential combination, tightly covering a pattern surface of a pattern with a covering film by suction applied to said pattern surface, coating the exposed surface of said covering film with solution of an initial condensate of a thermosetting resin in order to form a thermosetting resin layer on said covering film, placing a molding box in position on said covered pattern surface, filling a center cavity of said molding box with a fluid refractory filler, closing the exposed surface of said refractory filler, solidifying said refractory filler by suction applied thereto, removing said pattern from the remainder in order to form one mold half, preparing the other mold half in similar way, coupling said mold halves to each other in order to form a mold having an inner cavity and casting molten metal into said cavity of said mold.

2. Improved casting process as claimed in claim 1 in which said covering film is of a thermoplastic nature and subjected to said covering in heated state.

3. Improved casting process as claimed in claim 2 in which said covering film is a thermoplastic synthetic resin film.

4. Improved casting process as claimed in claim 3 in which said synthetic film is of a thickness in a range from 20 to 100 micronmeters.

5. Improved casting process as claimed in claim 1 in which the thickness of said thermosetting resin layer in the sense of the solid content is in a range from 2 to 100 micronmeters.

6. Improved casting process as claimed in claim 1 in which said thermosetting resin is chosen from the group consisting phenolic, furan and urea.

7. Improved casting process as claimed in claim 6 in which said phenol is novolak type phenolic resin.

8. Improved casting process as claimed in claim 7 in which the thickness of said thermosetting resin layer in the sense of the solid content is in a range from 5 to 40 micronmeters.

9. Improved casting process as claimed in claim 1 in which alcohol is used as the solvent for said initial condensate of said thermosetting resin.

10. Improved casting process as claimed in claim 1 in which said refractory filler is molding sand.

11. Improved casting process as claimed in claim 1 in which a thin synthetic resin film is used for closing said exposed surface of said refractory filler.

* * * * *